US005478581A

United States Patent [19]

Christie et al.

[11] Patent Number: 5,478,581

[45] Date of Patent: Dec. 26, 1995

[54] INFUSIBLE POUCH AND COVER

[76] Inventors: Hugh P. Christie, 56 Commercial Road, Hyde Park 5061; Allan K. Wallace, 15 Richard Street, Hindmarsh 5007, both of Australia

[21] Appl. No.: 108,607

[22] PCT Filed: Feb. 26, 1992

[86] PCT No.: PCT/AU92/00078

§ 371 Date: Aug. 28, 1993

§ 102(e) Date: Aug. 28, 1993

[87] PCT Pub. No.: WO92/15500

PCT Pub. Date: Sep. 17, 1992

[30] Foreign Application Priority Data

Feb. 27, 1991 [AU] Australia ..... PK4842

[51] Int. Cl.[6] ..... B65B 29/04

[52] U.S. Cl. ..... 426/80; 426/82; 426/77; 206/0.5

[58] Field of Search ..... 426/77, 80, 81, 426/82, 83, 84, 431, 432, 433, 435, 394; 206/0.5

[56] References Cited

U.S. PATENT DOCUMENTS

| | | | |
|---|---|---|---|
| 2,192,605 | 3/1940 | Salfisberg . | |
| 2,698,082 | 12/1954 | Maloney | 426/77 X |
| 2,728,670 | 12/1955 | Young et al. . | |
| 2,728,671 | 12/1955 | Young et al. . | |
| 2,728,672 | 12/1955 | Young et al. . | |
| 3,057,729 | 10/1962 | Grant | 426/80 |
| 3,387,978 | 6/1968 | Major . | |
| 3,566,573 | 3/1971 | Irmscher | 426/77 X |
| 3,895,118 | 7/1975 | Rambold | 426/83 |
| 3,899,599 | 8/1975 | Rambold | 426/82 |
| 4,055,668 | 10/1977 | Kopp | 426/83 X |
| 4,153,153 | 5/1979 | Herzog | 426/83 X |
| 4,726,956 | 2/1988 | Christie | 426/80 |
| 4,875,574 | 10/1989 | Travers | 206/0.5 |

FOREIGN PATENT DOCUMENTS

| | | |
|---|---|---|
| 107750 | 6/1939 | Australia . |
| 5066785 | 6/1986 | Australia . |
| 7398487 | 12/1987 | Australia . |
| 3866589 | 2/1990 | Australia . |
| 563756 | 5/1975 | Switzerland . |
| 2229991 | 10/1990 | United Kingdom . |

*Primary Examiner*—Steven Weinstein
*Assistant Examiner*—Milton I. Cano
*Attorney, Agent, or Firm*—Adams & Wilks

[57] ABSTRACT

An infusible pouch and cover assembly assembly comprises an infusible pouch containing an infusible substance, and a cover having a first leaf and a second leaf joined along a pair of adjacent edges. Each of the leaves has a hinge line adjacent to and spaced from the joined pair of edges, and the pouch is joined along a central portion of one of the adjacent edges to the first leaf below its hinge line so that the pouch can be inserted down the inside of a container with a wedging action on the pouch as it conforms to the inside shape of the container with the first leaf extending down the outside of the container. The two leaves are joined together over an area extending from the hinge lines to the joined edges of the leaves to thus form a portion in the form of a handle to be grasped by the user. The second leaf pivots about its hinge line, and the pair of joined edges pivot about the hinge line of the first leaf, so that combined angular pivoting of each leaf about its respective hinge line is sufficient for the second leaf to be swung at an angle greater than 180 degrees relative to the first leaf to which the pouch is attached. Preferably, the pivoting action of each leaf is less than 180°.

6 Claims, 3 Drawing Sheets

INFUSIBLE POUCH AND COVER

This invention relates to an infusible pouch and cover therefor, and also to a method and apparatus for the production of the pouch and cover.

BACKGROUND OF THE INVENTION

In my earlier U.S. Pat. No. 575226 there is described an infusible pouch or bag and cover. The infusible bag is attached at a central part of one edge of the bag to one leaf of a cover adjacent the hinge line joining the two covers made from a single sheet of cover material. The bag, which may be a tea bag or other infusible bag, when in use is positioned on the rim of a cup with the bag hanging down the inside of the cup. The leaf to which the bag is attached passes down the outside of the cup with the bag, due to the central attachment of the cover, generally conforming to the inside curvature of the cup. The other leaf is pivoted about the hinge line up to 270 to 360 degrees to thus extend away from the cup in a cantilever fashion to balance and thus support the bag in position. Thus the other leaf has to be swung away from the closed position up to nearly 360 degrees to thus stabilize and wedge the bag on the edge of the cup.

Also in my earlier U.S. Pat. No. AU587550 and Application No. AU38665/89 there are described methods and apparatus for the manufacture of the infusible bag and cover. The bags are fed onto a strip of the cover material, the bags attached thereto, the cover is creased, and then separated into separate covers each with a bag attached thereto, and finally the cover is folded about the bag. Thus the bags have to be positioned on the cover strip, and finally the cover has to be folded so that the leaves of the cover overlie the bag in a generally parallel relationship.

The above Patents describe an infusible bag which can be used as a tea bag or as a coffee bag or other infusible product and the method and apparatus for the production thereof. However with the cover and bag so produced in which the cover is formed a from a single reel or sheet of material and which is folded about a hinge line, the free leaf of the cover has to be pivoted about the hinge line nearly up to 270 to 360 degrees. However due to the nature of the material from which the cover is produced, the free leaf has a tendency to return back to less than the above angular rotation due to the inherent memory of the material from which it is produced. This could affect the stability of the bag and cover on the rim of the cup.

The above methods, apparatus and infusible bag and cover are particularly suitable for the small bags such as tea bags. However it has been found that if a larger bag for use with an infusible substance such as coffee, that certain problems arise. Thus with larger bags or pouches where the contents of the bag or pouch is increased from 2.5 grams to 7.0 grams for coffee, and although coffee has a higher density, there is still a large increase in volume and thus the size of the bag or pouch.

Thus the present invention has resulted as a result of the need to produce a cover for such a larger bag or pouch. When the previous machines were used for the production of the larger covers, problems arose in the folding of the cover strip back on itself due to the very flexible nature of the material used for it often did not fold correctly back over the bag or pouch.

Also this larger bag had user problems as it is more difficult to hold. It has been found that if a portion of the cover is in the form of a portion to be grasped, in the form of a handle that the pouch and cover after infusion of the substance, is much easier for the user to dispose of the pouch and cover. This handle is also of great advantage for the user when produced for the smaller tea bags also.

While the larger covers will use a degree of more material for the cover, there are further problems when two cover strips are used, these being supplied from twin reels, particularly on very high speed four lane production machines.

Thus the present invention overcomes the problems associated with the production of larger bags, and while the present invention is suitable for the larger bags and covers, it is also applicable to the smaller tea bags and results in a tea bag and cover with added advantages.

Thus it is an object of this invention to provide an infusible bag and cover in which a portion is provided in the form of a handle to improve ease of use by the user, particularly for larger infusions such as coffee bags.

Also it is a further object of this invention to provide an infusible bag and cover in which the free leaf does not have to pivot about its hinge line to the extent required by the above discussed product.

It is a further object of this invention to provide an infusible bag and cover in which each leaf is provided with its own hinge line or pivot line.

It is also a further object of this invention to provide an improved method and apparatus for the production of a combined infusible bag and cover.

It is a further object of the invention to provide an infusible bag and cover in which the cover is sealed around all of its edges to thus enclose the infusible bag to thus protect the contents from deterioration due to contact with the atmosphere, the flavour and aromatic constituents of the product thus being preserved.

BRIEF DESCRIPTION OF THE INVENTION

Thus there is provided according to invention an infusible pouch and cover, the infusible pouch containing an infusible substance such as coffee or tea, the cover being formed of two leaves joined along a pair of adjacent edges, each of the leaves having a hinge line adjacent to and spaced from the joined pair of edges, the pouch being joined along a central portion of one of its edges to one of the leaves adjacent its respective hinge line so that the pouch can be inserted down the inside edge of a cup with a wedging action on the pouch, with one leaf extending down the outside of the cup, characterized in that the two leaves are joined together over an area extending from adjacent the attachment of the pouch to said one leaf to the adjacent edge of the leaves to thus form a portion in the form of a handle to be grasped by the user.

Preferably the free other leaf is pivoted about its hinge and the pair of joined edges pivot about the hinge of said one leaf so that the combined angular pivoting of each leaf about its respective hinge line is sufficient for the leaf to which the bag is not attached to be swung at an angle greater than 180 degrees relative to the leaf to which the bag is attached.

Preferably in use the combined angular pivoting of each leaf about its respective hinge is sufficient for the leaf to which the bag is not attached to be swung at an angle less than 180 degrees relative to the leaf to which the bag is attached. Thus each leaf would swing or pivot less than 180 degrees.

Also preferably the interior of the sealed cover may be evacuated and/or purged with an inert gas to assist in the preservation of the contents.

Further the portion of the two leaves extending beyond the crease or pivot line of the leaves can be used as a portion to be grasped to assist in the ease of handling of the infusible bag and cover whereby the leaves may be folded over against the infusible bag so that the excess liquid may be squeezed from the contents of the pouch and disposed of while holding this portion of the cover.

Also there is provided according to the invention a method of forming an infusible pouch and cover, the method comprising the steps of orientating and positioning the pouch on a first web of cover material, attaching an infusible pouch containing an infusible substance by an edge of the pouch centrally of the cover, positioning a second web of cover material over the pouch and the first web of cover material, joining the two webs together adjacent said edge of the pouch, forming a hinge line in each of the webs of cover material adjacent said edge of the pouch joined to the first web of cover material, and severing said webs to form individual envelopes each containing an infusible pouch.

In a further form of the invention the method includes the step of sealing or joining the cover around each of the edges of the cover.

In a still further form of the invention the method includes the step of purging the space between the cover before sealing around the edges and/or flushing with an inert gas.

There is also provided according to the invention an apparatus for forming an infusible pouch and cover, the apparatus including positioning means to position and orientate a pouch on a first web of cover material, attaching means to attach the pouch containing an infusible substance by an edge of the pouch centrally of the web, feeding means to position a second web of cover material over the pouch and the first web of cover material, joining means to join the two webs together adjacent said edge of the pouch, creasing means to form a hinge line in each of the webs of cover material adjacent the said edge of the pouch joined to the first web of cover material, and cutting means to sever the webs to form individual envelopes each containing an infusible pouch.

BRIEF DESCRIPTION OF THE DRAWINGS

In order to more fully describe the invention reference will now be made to the accompanying drawings in which.

DESCRIPTION OF THE PREFERRED EMBODIMENT

Figure 1:
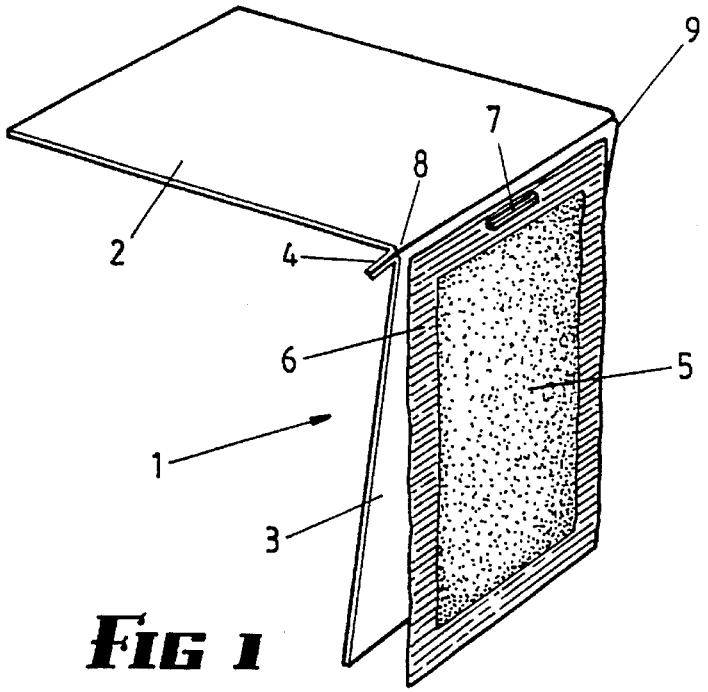
FIG. 1 is an isometric view of one form of an infusible pouch and cover.
Figure 2:
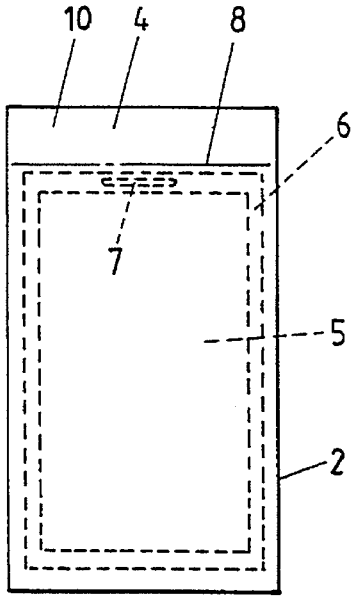
FIG. 2 is a front view of the embodiment of FIG. 1.
Figure 3:
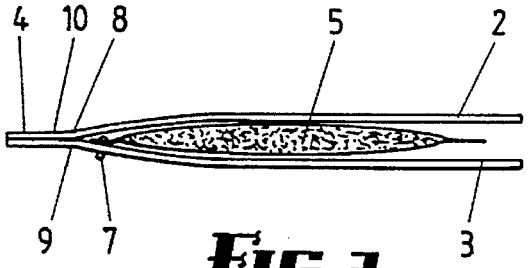
FIG. 3 is a side view of the embodiment of FIG. 1.

Referring firstly to FIGS. 1,2 and 3 of the drawings, the combined cover and pouch 1 comprises a first leaf 2 and a second leaf 3 which are sealed or joined together by a weld or seal 4 along one of their adjacent edges. The pouch 5 containing an infusible substance is attached to the second leaf 3 by its edge 6 by means of a staple 7. The attachment can also be by means of a heat seal, weld or adhesive. The edge 6 is attached centrally thereof to the leaf so that the pouch is attached by a central portion or location centrally of the edge and also centrally of the leaf.

The leaves 2 and 3 are each provided with a respective hinge line 8 and 9, and that portion of the hinge lines and in the area of the seal forms a portion 10 which is easily grasped by the user to manipulate the cover and the infusible bags. This is later described in more detail.

During the following description while reference is made to the positioning of the pouch on the edge of a cup, it is to be realized that this can be any suitable container to hold the liquid in which the substance in the pouch is to be infused. In use the pouch will be positioned inside a cup down the inside edge thereof and supported on the edge of the cup with the second leaf 3 hanging down the outside of the cup. The first leaf 2 is then swung up and away from the cup and pivots about the portion 10 by the hinge 8, and at the same time the portion 10 will also pivot about the hinge 9 connecting the portion 10 to the leaf 3. Thus neither leaf need pivot more than 180 degrees, and as the hinge lines in the leaves will preferably be formed with a creasing tool, this limited pivoting is of advantage, for when card, plastics material or coated card is creased, due to the resilience of the material particularly when the leaves are pivoted more than 180 degrees there is a tendency for the leaves to swing back to the straight position.

To remove the pouch and cover from the cup, the portion 10 can be grasped to lift it from the cup and the first leaf 2 folded over the pouch so that the leaves can be squeezed together to remove the excess fluid from the contents of the pouch. By grasping the portion 10, the fingers of the user are kept away from the liquid which usually is hot, and is easy then to handle the cover and pouch for disposal.

Figure 4:
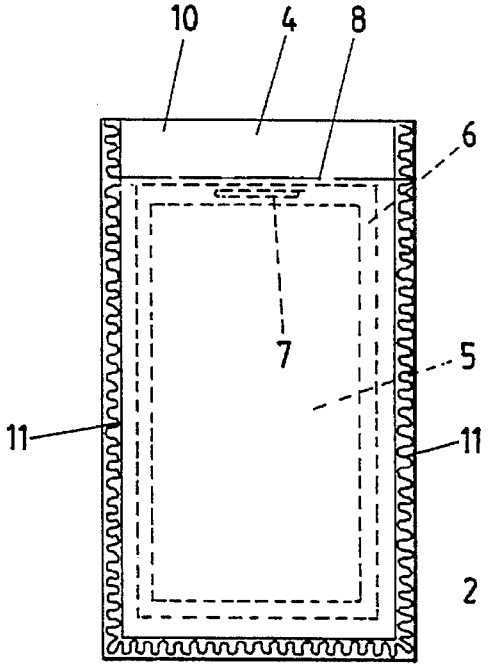
FIG. 4 is a front view of a second form of the invention.
Figure 5:
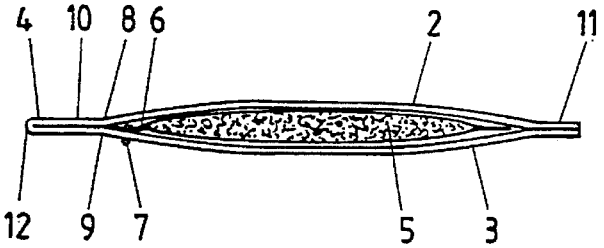
FIG. 5 is a cross sectional view of the embodiment of FIG. 4.

Referring now to FIGS. 4 and 5, there is shown a further form of the invention in which the side edges and the bottom edge of the leaves 2 and 3 are sealed by a seal 11 which is a releasable seal so that the leaves may be separated to allow the pouch to be inserted into a cup as above described. The side edges and the bottom edge are sealed to prevent deterioration of the infusible substance for instance by exposure to the atmosphere. Alternately the seal area 11 may be removed from the leaves 2 and 3 by tear-off strips, in which instance the seal 11 need not comprise a releasable adhesive.

The embodiment of FIGS. 4 and 5 can be formed of the two separate leaves as described in relation to FIGS. 1 to 3, however as shown in FIG. 5, the two leaves 2 and 3 are formed from the same sheet of cover material. Thus the leaves are formed by folding the sheet material so that the leaves are joined by a fold 12 and the two portions of the leaves adjacent the fold are then attached to each other. This attachment can be by staples, by heat sealing or gluing to thus form the portion 10 which has a similar function to that described above. In this way the portion 10 will be relatively firm or rigid to thus provide a convenient portion or handle to manipulate the pouch and cover. Each of the leaves is creased or otherwise formed to have the hinges 8 and 9 at the edge of the portion 10 and the pouch 5 is attached to the leaf 3 as above described.

Thus as shown in FIG. 1 each of the leaves 2 and 3 are pivotable about their hinges to the portion 10, each thus pivoting less than 180 degrees to the positions which generally would be when positioned on a cup.

Figure 6:
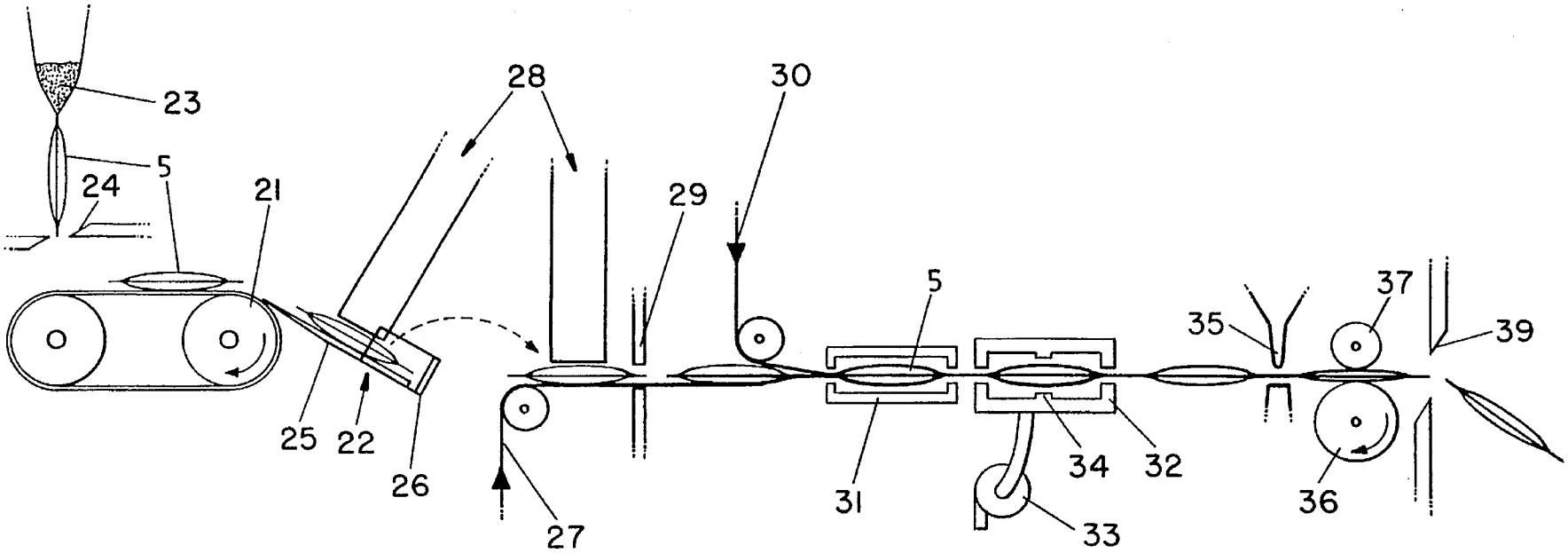
FIG. 6 shows one form of apparatus for carrying out the invention.

One form of machine to form the envelopes comprising the cover and the infusible pouch is shown schematically in FIG. 6. The pouch 5 is positioned on a feed conveyor 21 which passes the pouches onto a vibrating pouch straightener 22 to correct the variable positioning of the pouches. In the example shown the pouches may be fed onto the conveyor direct from a pouch making machine 23, a knife 24 separating the pouches before they are positioned on the conveyor 21.

The vibrating straightener 22 is provided in order to tolerate the variable positioning of the dropped pouch. The pouch is dropped onto a static sloping table 25 so that it Slips until it touches a ledge 26. The ledge 26 oscillates laterally to work the pouch into correct orientation and registration against itself. Sidewalls attached to the ledge 26 register the sides of the pouch at the extreme inner position of their travel. It will be realized that other forms of transfer and positioning means can be used as is well known in the art.

The pouches 5 are then positioned on a lower web of cover material 27 by a vacuum transfer finger 28 which picks up the correctly orientated pouch 5 and positions it on the lower cover web 27. When it is so positioned the pouch is attached to the web 27 by a heat sealing tool 29 which attaches the pouch 5 by an edge to the web 27 of cover material centrally of the edge. The upper web of cover material 30 is then positioned over the attached pouch and the lower web, which then pass into the primary sealer 31 which seals both ends and most of the sides of the envelope to be formed.

The webs and pouch then pass to the next station which is the air extraction and final seal chamber 32. This chamber 32 is connected to a vacuum pump 33 and also has sealing members 34 to seal the unsealed portion of the sides of the cover when the air has been extracted from the cover and thus the pouch. Following this the webs and pouch pass to a hinge forming tool 35 which has a radiused crushing end to crush the webs against an elastomeric backing to form the hinge in both so formed leaves.

The movement of the webs through the machine is provided by a feed roller 36 and pressure roller 37 following which the individual envelopes are separated by a knife 39.

It will be realized that the upper web of material could be printed in which case the upper and lower systems would be interchanged. Additionally the lower web can be printed, either in specific areas, or randomly or all over the web. If it is printed in one portion only, then registration of the two sheets of covers would be required. Also one or both webs could be notched with either an angular notch or curved notch at the end of each produced cover so that the cover would have cut off or rounded corners. In this case instead of there being a print detector, there can be an optical or mechanical detector to detect the passage of each notch to thus control the feed.

Also in a further embodiment, instead of there being two separate sealing units, there could be one sealing unit which would seal and evacuate in the one operation. Furthermore instead of evacuation, the covers could be gas flushed with an inert gas before sealing. Also it is to be noted that the particular arrangement of the drive and guide rollers for the webs could be varied from that described.

Also if it is desired that the cover not be sealed all around the periphery of the cover, then the two leaves need only be joined along one transverse line, or alternatively along one longitudinal edge, as long as the two separate leaves are joined together.

Also it is to be noted that in the above embodiments, the pouches may be positioned across the first web of material and the attachment of the pouch to the web of cover material may be adjacent to edge of the web instead of as above described, centrally of the web.

Figure 7:
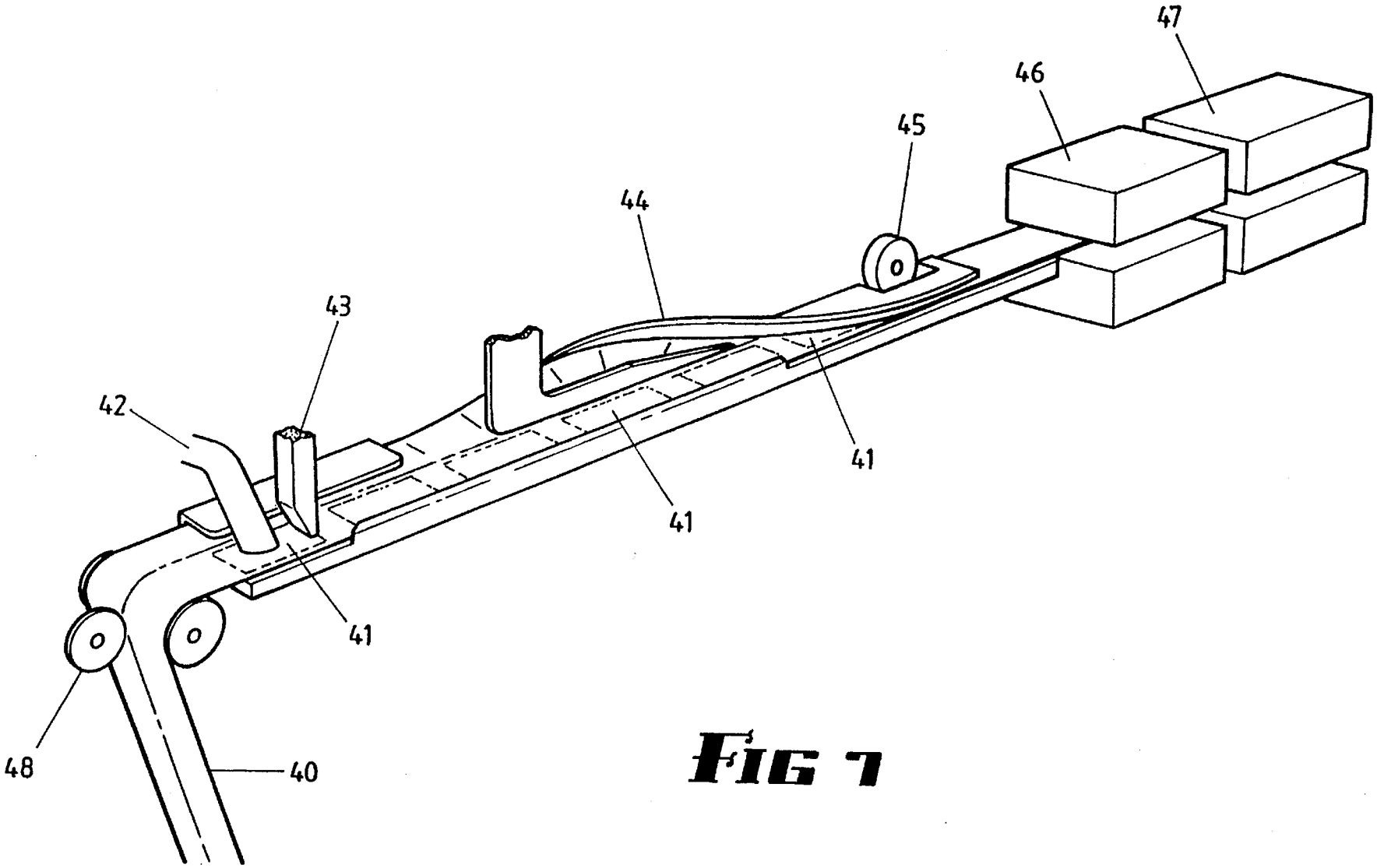
FIG. 7 shows another form of apparatus for carrying out the invention.

Referring now to FIG. 7 there is shown a further embodiment of the invention in which the second web of cover material is formed by a portion of the first web of cover material being folded back over itself.

In this embodiment the web 40 has the infusible pouch 41 positioned on one side of the web 40, such as by a vacuum transfer finger 42, the pouch then being attached to the web centrally of the pouch and web by a pouch attach member 43. The pouch may be attached by an edge of the pouch which is transverse of the web such as the leading edge as shown, or in an alternate form the pouch may be attached by the edge which is longitudinal of the web and preferably by the edge nearest the center of the web.

Following the attachment of the pouch to the web, a folding plough 44 folds over the web so that the folded over portion overlies the other portion of the web and the pouch. The folded over portion is then passed under a creasing roller 45. If the formed envelope is to completely enclose the pouch the web and pouch then pass to a primary sealing unit 46 and then to an extraction or flushing unit 47 where the final sealing also takes place. The creasing of the covers may take place as above described in relation to FIG. 6.

If the final product is not to be sealed with a releasable seal, or not to have the free edges joined to each other by a tear-off type of joint, after the web and pouches pass the edge creaser, the web may be severed to form the individual units of pouches and covers.

The cover web may be pre-creased by a pre-creasing roller 48.

Thus the cover material comes from a single reel with the print sychronisation system as described above. The pre-creasing roller crushes the cover material along the longitudinal fold line. This pre-creasing could occur at any position upstream of the folding plough, including the final delivery roller as shown, or perhaps more conveniently at the dive roller which feeds the slack loop as described in the previous embodiment.

After pouch attachment, the upper cover portion is ploughed over a length to suit the cover material. A following creasing roller is shown to complete the fold before the product enters the primary sealing station.

Thus it will be seen that there is provided according to the invention an infusible pouch and cover in which the pouch can be hung on the edge of a cup, the pouch extending down the inside of the cup, one leaf of the cover extending down the outside of the cup, and the other leaf extended back away from the pouch to assist in stabilizing the pouch and cover on the cup edge. The pouch is attached to one of the leaves, and the portion of the leaves extending beyond the attachment point are joined together, with each leaf being pivotable to this extending portion. In this way each leaf of the cover is independently pivoted to the extending portion so that the extended portion can pivot relative to the leaf extending down the outside of the cup, and the other leaf can thus also pivot relative to the extended portion. In this way each leaf does not have to pivot to any great extent, and each tends to thus remain its pivoted position. As above described, the cover may be formed from two separate strips of cover material, or from a single strip which is folded back over the pouches by a plough as described in FIG. 7.

Also this extended portion thus forms a convenient portion to be grasped by the user, thus in effect forming a handle.

We claim:

1. An infusible pouch and cover assembly comprising: an infusible pouch containing an infusible substance, a cover comprising a first leaf and a second leaf joined along a pair of adjacent edges, each of the leaves having a hinge line adjacent to and spaced from the joined pair of edges, the pouch being joined along a central portion of one of the adjacent edges to the first leaf below its hinge line so that the pouch can be inserted down the inside of a container with a wedging action on the pouch as it conforms to the inside shape of the container with the first leaf extending down the outside of the container, wherein the two leaves are joined together over an area extending from the hinge lines to the joined edges of the leaves to thus form a portion in the form of a handle to be grasped by the user, and wherein the second leaf pivots about its hinge line and the pair of joined edges pivot about the hinge line of the first leaf so that combined angular pivoting of each leaf about its respective hinge line is sufficient for the second leaf to be swung at an angle greater than 180 degrees relative to the first leaf to which the pouch is attached.

2. An infusible pouch and cover assembly as defined in claim 1; wherein the pivoting action of each leaf is less than 180 degrees.

3. An infusible pouch and cover assembly as defined in claim 1; wherein the cover extending from the hinge lines of the respective leaves forms a handle which can be conveniently grasped by the user.

4. An infusible pouch and cover assembly as defined in claim 1; wherein the edges of the leaves are sealed to each other to thus fully enclose the pouch.

5. An infusible pouch and cover assembly as defined in claim 4; wherein the space between the leaves is purged of air before sealing of the edges.

6. An infusible pouch and cover assembly as defined in claim 4; wherein the space between the leaves is purged of air and filled with an inert gas before sealing of the edges.

* * * * *